United States Patent [19]

Black

[11] Patent Number: 4,469,057

[45] Date of Patent: Sep. 4, 1984

[54] POPPET VALVE SPRING RETAINER WITH INTEGRAL MECHANICAL ADJUSTABLE TAPPET

[76] Inventor: Alfred A. Black, 126 Beaver St., Framingham, Mass. 01701

[21] Appl. No.: 336,283

[22] Filed: Dec. 31, 1981

Related U.S. Application Data

[63] Continuation-in-part of Ser. No. 055,951, Jul. 9, 1979, Pat. No. 4,321,894.

[51] Int. Cl.[3] ..... F01L 1/22

[52] U.S. Cl. ..... 123/90.54; 123/90.67

[58] Field of Search ..... 123/90.48, 90.51, 90.52, 123/90.53, 90.65, 90.67, 90.54, 90.66

[56] References Cited

U.S. PATENT DOCUMENTS

| | | | |
|---|---|---|---|
| 1,473,711 | 11/1923 | Sherbondy | 123/90.52 |
| 1,857,005 | 5/1932 | Schotthoefer | 123/90.52 |
| 3,298,337 | 1/1967 | Thompson | 123/90.67 |
| 3,301,239 | 1/1967 | Thauer | 123/90.67 |
| 3,823,698 | 7/1974 | Van Deberg | 123/90.54 |
| 4,201,162 | 5/1980 | Speckhart | 123/90.67 |

FOREIGN PATENT DOCUMENTS

| | | | |
|---|---|---|---|
| 0211452 | 1/1924 | United Kingdom | 123/90.52 |

*Primary Examiner*—Craig R. Feinberg
*Assistant Examiner*—W. R. Wolfe
*Attorney, Agent, or Firm*—William Nitkin

[57] ABSTRACT

A device of the type for the adjustment of the gap between the valve stem and rocker arm or cam shaft of an internal combustion engine having a lower valve spring retainer base and upper cap member with adjustment means associated therewith incorporating an improved valve stem receipt member and improved cap retention member.

12 Claims, 2 Drawing Figures

POPPET VALVE SPRING RETAINER WITH INTEGRAL MECHANICAL ADJUSTABLE TAPPET

This application is a continuation-in-part of my previously filed application for Poppet Valve Spring Retainer with Mechanical/Hydraulic Adjustment Means for Internal Combustion Engine filed July 9, 1979 having Ser. No. 055,951, now U.S. Pat. No. 4,321,894.

BACKGROUND OF THE INVENTION

1. Field of the Invention

The device of this invention resides in the area of valve adjustment means for internal combustion engines having overhead cams or rocker arms and more particularly relates to a valve spring retainer including means for adjustment of the gap between the cam shaft and/or rocker arm and valve stem.

2. History of the Prior Art

In typical overhead cam engines the valves are operated by a rocker arm pushing on the valve stem or cam shaft pushing on bucket tappets. The rocker arm is usually actuated by a cam located in association therewith. In order to provide for the thermal expansion of the valve stem due to the heat created by the fuel combustion within the engine, gaps are usually provided between the valve stem and rocker arm. Most adjustments of the gap mentioned above are accomplished by means of a locked screw or the use of shims placed within the bucket member positioned over the valve spring retainer. Although such adjustments are relatively simple, in many instances one must remove the cam shaft from the vehicle in order to place the shims in position under the bucket. In other systems the bucket may be adjusted by providing a screw member threaded across the top of the valve stem at an angle so that if it is rotated upward, it raises the bucket or if it is rotated downward, it lowers the bucket. The following patents relate to the general area of this invention:

| U.S. Pat. No. | Name |
|---|---|
| 1,857,005 | Schotthoefer |
| 2,142,224 | Turlay |
| 2,722,204 | Wente |
| 3,270,726 | Cotton |
| 3,675,631 | Hixson |
| 3,823,698 | Van Deberg |

SUMMARY OF THE INVENTION

It is an object of this invention to provide a device for the adjustment of the gap between a valve stem and rocker arm which is substantially lighter in weight to that used in the present art, which is significantly less bulky, which replaces three to four elements now utilized to accomplish the same adjustment, and which removes the point of direct actuation of the valve stem from its top thereby lessening the stress on such stem and allowing it to be lighter in weight. It is a further object that the valve spring's resistance to compression not be transferred directly to the top of the valve stem as presently done in the prior art.

The device of the present invention is comprised of a valve spring retainer base which is adapted to fit over the valve spring and has an aperture through a central portion thereof for receipt of the valve stem, and lip means for the engagement of an outer and inner valve spring if such is used in the engine. The valve spring retainer base further has a central portion threaded on its inside and an upwardly extending outer portion threaded along its inside. The outer valve spring lip member located below the outer threaded portion of the valve spring retainer base projects downward to fit over, engage, and retain the outer valve's spring. A valve adjuster cap is also provided having on its bottom a central projection with threads upon the outer portion thereof adapted to be threadedly engaged into the inner threaded portion of the valve spring retainer base. The valve adjuster cap has along its outer periphery a threaded portion adapted to engage into the outer threaded portion of the valve spring retainer base. The top of the valve adjustor cap may have a plurality of apertures defined around its top surface perimeter. A split ring lock member is provided which has hook members adapted to engage into selected ones of the plurality of apertures disposed around the periphery of the valve adjustor cap so that when the valve adjustor cap is rotated within the valve spring retainer base to its desired height for the adjustment of the gap between the valve stem and the rocker arm, it may be locked into position by the placement of the split ring lock member with the hooks thereof engaged into the closest of the apertures within the valve adjustor cap. Within the central portion of the projection centrally located on the underside of the valve adjustor cap is defined an area adapted for receipt of a valve stem spring member which fits therein and a valve stem bushing. The valve stem bushing has a projection upon one side thereof which engages the valve stem spring member. The valve stem bushing is adapted to fit into the valve stem bushing receipt area defined within the valve spring retainer base. The valve stem receipt aperture defined in the valve spring retainer base is constructed somewhat more narrowly at its base than at its top. A steel insert may be positioned within the valve stem receipt aperture for use to prevent excessive wear when the rest of the assembly is made of aluminum. When the valve stem is positioned therein, a valve ring clip is placed within a groove in the top of the valve stem which is then adapted to move freely in the top of the valve stem receipt aperture but not pass downward out of the valve stem receipt aperture due to the fact that the base of the valve stem receipt aperture is narrower than the valve ring clip positioned on the valve stem. When positioned on the valve stem, this clip retains the structure of this invention in place on top of the valve stem, and the valve spring is compressed keeping the valve in an upward position closing its associated port. When the top of the valve adjustor cap is struck by the cam directly or in some cases by the rocker arm, the valve's port will be opened.

It has been found preferable to have the valve adjustor cap supported at both its center and its periphery rather than merely at one or the other position to prevent deformation at its center and to help distribute the force load more evenly over the top surface of the valve adjustor cap. It is expected that in the operation of this device, the valve stem will rotate to various positions during use which rotation assists in the distribution of any stress thereon. To prevent any difficulty in threading the valve adjustor cap into the valve spring retainer base due to unmatched threads between the inner and outer threads, one may in an additional embodiment have the valve adjustor cap constructed of two pieces, one being the outer threaded ring with a lip for the support of the outer portion of the inner cap. The valve adjustor cap may also have an insert aperture defined therein to receive a polygonal hardened steel insert if the valve cap and valve spring retainer base are to be constructed of aluminum or other light metal which might wear too easily from the action of the rocker arm or cam.

The spring-loaded bushing has been provided to help keep the valve in place when the device of this invention is depressed. It further assures that the valve stem will move downward at the same time or at an extremely short time after the device of this invention has started its downward movement. It still further allows for the possibility of expansion of the valve stem therein expecially when the retainer adjustor is adjusted for a zero gap. Further, it helps eliminate a certain amount of the noise caused by the valve stem striking directly against the valve adjustor cap. It also keeps pressure on the valve stem even when the device of this invention is depressed to prevent or minimize any upward movement of the valve stem on its own as the depressing force of the valve cap is not focused directly upon the stem of the valve but is on the valve spring.

In some embodiments there may be provided one or more holes drilled within the valve spring retainer base that would allow oil to circulate within the chamber formed between the valve spring retainer base and the valve adjustor cap. The oil circulating through these holes will provide lubrication within the chamber and will also assist in decreasing noise by filling the relatively open chamber in which there might tend to be certain resonances. This embodiment will also assist in keeping the valve spring retainer base and valve adjustor cap cooler so that heat from cam shaft friction and heat transferred from the valve head through the valve stem to this invention would not cause significant expansion thereof.

DESCRIPTION OF THE PREFERRED EMBODIMENT(S)

Figure 1:
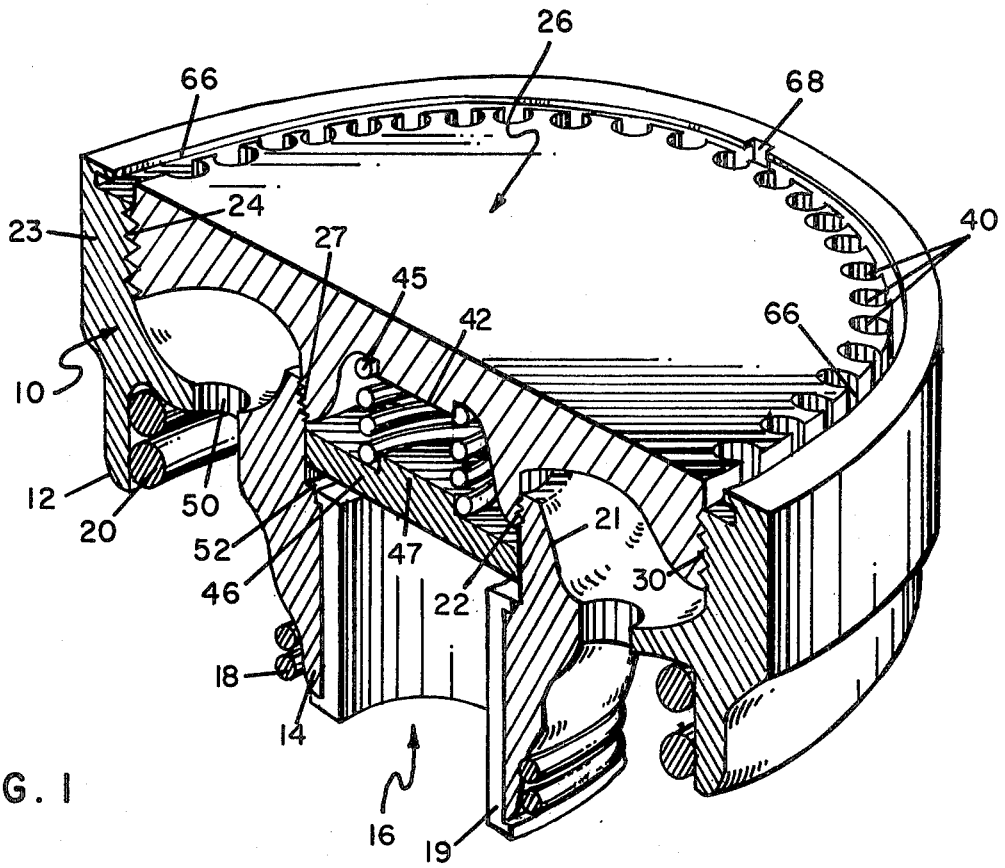
FIG. 1 is a perspective cross-sectional view of the device of this invention incorporating a steel insert in the valve stem receipt aperture and lock member.
Figure 2:
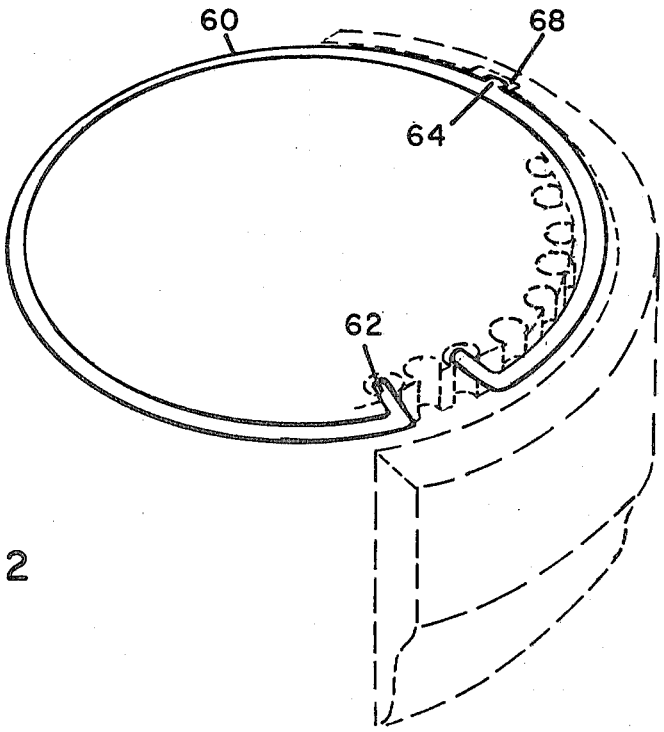
FIG. 2 is a view of the split ring lock member.

In FIG. 1 valve spring retainer base 10 has on its bottom portions a protruding outer valve spring retaining lip 12 into which is engaged outer valve spring 20. Also seen in this view are inner valve spring lip 14 into which is engaged inner valve spring 18 and valve stem receipt aperture 16 into which the valve stem passes. Insert 19 which can be made of a hard metal such as steel is seen located inside around the valve stem receipt aperture 16 which insert 19 is to prevent excessive wear of the assembly if the assembly is made of a lighter material such as aluminum. Aperture 16 is somewhat narrower at its base than at its top and acts to engage the valve stem due to a small clip inserted into a groove at the top of the valve stem. The valve stem is not shown in this illustration for the sake of clarity since such a valve stem and clip within a groove are well-known in the prior art and are used in the prior art to hold the valve spring cap in place thereon. Seen in a central portion of the valve spring retainer base 10 is valve stem bushing receipt ledge 52. Projection 21 is centrally positioned above the valve stem receipt aperture and has a threaded portion 22 along its insides. Valve spring retainer base 10 has an upwardly extending portion 23 along its periphery having along the inside thereof an inner threaded portion 24. Seen threaded into valve spring retainer base 10 is valve adjustor cap 26. A portion of the valve adjustor cap 26 protrudes downward at a central portion, its threading 27 engaging central threaded portion 22 of the valve spring retainer base 10. The outer portions of valve adjustor cap 30 can also be threaded to engage into and adjust in an upward and downward fashion as it is rotated within the valve spring retainer base 10. A split ring lock member 60 seen in FIG. 2 is positioned with its hooks 62 inserted into selected lock member apertures 40 seen within the valve adjustor cap. Its lock protrusion 64 is seen inserted into lock receipt aperture 68 defined within channel 66 into which split ring 60 is inserted. Once cap 26 is rotated into its desired position by a tool having downward projections adapted to engage into the lock member apertures 40, the split ring lock member 60 is inserted into channel 66 and its hooks 62 retain the cap while its lock protrusion 64 engages into lock receipt aperture 68 which prevents further rotational movement of split ring lock member 60 and cap 26 until the split ring lock member is removed.

A valve stem bushing 46 is provided and adapted to rest upon its ledge 52 within the valve spring retainer base, and a spring member 45 is provided to engage both a protruding portion of the valve stem bushing 47 and a projection 42 thereabove on the valve adjustor cap to keep pressure on the valve stem as described above. A plurality of apertures 50 may be provided within the valve spring retainer base and adjustor cap member to allow for the flow of oil therethrough.

Although the present invention has been described with reference to particular embodiments, it will be apparent to those skilled in the art that variations and modifications can be substituted therefor without departing from the principles and spirit of the invention.

I claim:

1. A device for gap adjustment between a valve stem and its operation means within an internal combustion motor of the type having a valve spring retainer member adapted to be retained upon said valve stem, a first adjustment means incorporated into said valve spring retainer member for adjustment of said gap, a lower valve spring retainer member having a valve stem receipt aperture defined therein, a cap member, means for adjustment of said cap member in relation to said valve spring retainer member for adjustment of said gap, and a second adjustment means disposed above said valve stem receipt aperture for adjusting the gap between the top of said valve stem and said cap member and limiting the protrusion of said valve stem into said valve stem receipt aperture while allowing for the thermal expansion and reciprocating movement of said valve stem wherein the improvement comprises an improved means of adjustment of said cap member including:

a plurality of apertures defined around the perimeter of the top surface of said cap;

means to engage said apertures and rotate said cap to a desired position;

lock means to retain said cap in said position, said lock means including:

a split ring member;

hook members extending on an arc radius from said split ring member, and each adapted to engage into one of said apertures defined in said cap;

a channel defined in said lower valve spring retainer member for receipt of said split ring member;

a lock receipt aperture defined within said channel; and a lock protrusion on said split ring alignable and insertable into said receipt aperture when said split ring is in said channel and said hook members are in said selected apertures in said cap so as to prevent rotation of said ring and said cap.

2. A device for gap adjustment between a valve stem and its operation means within an internal combustion motor of the type having a valve spring retainer member adapted to be retained upon said valve stem, a cap member, and means for adjustment of said cap member in relation to said valve spring retainer member for adjustment of said gap, wherein the improvement comprises an improved means of adjusting and locking said cap member in its desired position including:

a plurality of apertures defined around the perimeter of the top surface of said cap adapted to be engaged by a tool to rotate said cap to a desired position;

a split ring member;

hook members extending on an arc radius from said split ring member, each hook member adapted to engage into one of said apertures defined in said cap;

a channel defined in said valve spring retainer member for receipt of said split ring member;

a lock receipt aperture defined within said valve spring retainer at a point on the periphery of said channel; and a lock protrusion member on said split ring adapted to be alignable and insertable into said lock receipt aperture when said split ring is positioned in said channel and said hook members are positioned in selected apertures in said cap so as to prevent rotation of said ring and said cap.

3. An adjustor for an adjustment of a thermal expansion gap between a valve stem and its operation means within an internal combustion engine of the type having a valve spring retainer member having a valve stem receipt aperture therein, said structure adapted to be the adjustor's body comprising:

said valve spring retainer member being non-fixedly retained upon said valve stem;

a cap member adjustably attached to said valve spring retainer member;

means for adjustment of a first gap between said cap member and said operation means and adjustment of a second gap between said cap member and said valve stem wherein said means for adjustment include means to raise or lower said cap member in relation to valve spring retainer member to a position which prevents the cap member from constant contact with said valve stem, said cap adapted to be of a type not directly attached to said valve stem or in any way to fix said stem immovably in said valve stem receipt bore;

lip means defined on said valve spring retainer base for lateral retention of said valve spring;

locking means to retain said cap device in a selected position in relation to said valve spring retainer;

means for limitation of the movement of said valve stem through said valve stem receipt aperture including means to allow the thermal expansion and reciprocating movement of said valve stem within said valve stem receipt aperture; and means of adjusting and locking said cap member including:

a plurality of apertures defined around the perimeter of the top surface of said cap;

means to engage said apertures and rotate said cap to a desired position;

lock means to retain said cap in said position, said lock means including:

a split ring member;

hook members extending on an arc radius from said split ring member and adapted to engage into one of said apertures defined in said cap;

a channel defined in said valve spring retainer member for receipt of said split ring member;

a lock receipt aperture defined within said channel, and a lock protrusion member on said split ring member alignable and insertable into said lock receipt aperture when said split ring is in said channel and said hook members are in said selected apertures defined in said cap and in said valve spring retainer so as to prevent rotation of said split ring and said cap member.

4. An adjustor for an adjustment of a thermal expansion gap between a valve stem and its operation means within an internal combustion engine of the type having a valve spring retainer member having a valve stem receipt aperture therein, said structure adapted to be the adjustor's body comprising:

said valve spring retainer member being non-fixedly retained upon said valve stem;

a cap member adjustably attached to said valve spring retainer member;

means for adjustment of a first gap between said cap member and said operation means and adjustment of a second gap between said cap member and said valve stem wherein said means for adjustment include means to raise or lower said cap member in relation to valve spring retainer member to a position which prevents the cap member from constant contact with said valve stem, said cap adapted to be of a type not directly attached to said valve stem or in any way to fix said stem immovably in said valve stem receipt bore;

lip means defined on said valve spring retainer base for lateral retention of said valve spring;

locking means to retain said cap device in a selected position in relation to said valve spring retainer; and means for limitation of the movement of said valve stem through said valve stem receipt aperture including means to allow the thermal expansion and reciprocating movement of said valve stem within said valve stem receipt aperture wherein said valve stem receipt aperture has a lining of a material harder than the material of said valve spring retainer member.

5. A device for gap adjustment between a valve stem and its operation means, said device interposed therebetween with a gap between said device and said operation means, within an internal combustion motor, comprising:

a valve spring retainer member adapted to be retained upon said valve stem;

dual adjustment means incorporated into said valve spring retainer member for said gap adjustment between said valve stem and said operation means;

locking means to retain said device in a selected position in relation to said valve spring retainer;

said device further including:

a lower valve spring retainer member having a valve stem receipt aperture defined therein;

a cap member engaged in said valve spring retainer member with a gap defined between said cap member and said valve stem;

a lock member;

said dual adjustment means including:

means for adjustment of said cap member in relation to said valve spring retainer member for adjustment of gap between said device and said operation means;

means for adjustment of the gap between said valve stem and said cap member;

said device further including:

locking means to retain said cap member in immovable relation to said valve spring retainer member for preservation of said gaps; wherein said means of adjusting and locking said cap member, further includes:

a plurality of apertures defined around the perimeter of the top surface of said cap;

means to engage said apertures and rotate said cap to a desired position;

lock means to retain said cap in said position, said lock means including:

a split ring member;

hook members extending on a arc radius from said split ring member, each hook member adapted to engage into one of said apertures defined in said cap;

a channel defined in said lower valve spring retainer member for receipt of said split ring member;

a lock receipt aperture defined within said channel; and a lock protrusion on said split ring alignable and insertable into said receipt aperture when said split ring is in said channel and said hook members are in said selected apertures in said cap so as to prevent rotation of said ring and said cap.

6. The device of claim 5 wherein said valve spring retainer has defined therein:

a valve stem receipt aperture adapted to receive said valve stem;

means for limitation of the protrusion of said valve stem into said valve stem receipt aperture while allowing for the thermal expansion and reciprocating movement of said valve stem; and a hard metal insert disposed within said valve stem receipt aperture to prevent wear of said device when said device is constructed of a softer material such as aluminum.

7. In combination, apparatus for an adjustment of a thermal expansion gap between a valve stem and structure operating the valve stem within an internal combustion engine comprising:

a valve spring retainer member having a valve stem receipt aperture receiving at least a portion of the valve stem thereinto, the valve spring retainer member freely receiving the portion of the valve stem and being unattached to and non-fixedly retained upon said valve stem;

a cap member adjustably attached to said valve spring retainer member, the cap member being unattached to the valve stem and being freely movable relative thereto; and a first means carried by the valve spring retainer member and being unattached to the valve stem for adjustment of a first gap between said cap member and said operating structure and a second means carried by the valve spring retainer member and being unattached to the valve stem for adjustment of a second gap between any part of said cap member and said valve stem wherein said second adjustment means is independent of the adjustment of the cap member upon the valve stem and includes means to raise or lower said cap member in relation to the valve spring retainer member to a position which during normal operation prevents the cap member from being in constant direct contact with said valve stem.

8. The device of claim 7 further including locking means to retain said cap device in a selected position in relation to said valve spring retainer member.

9. The device of claim 7 including lip means defined on said valve spring retainer member for lateral retention of a valve spring on said member.

10. The device of claim 9 further including locking means to retain said cap device in a selected position in relation to said valve spring retainer member.

11. The device of claim 10 further including means for limitation of the movement of said valve stem through said valve stem receipt aperture.

12. The device of claim 11 wherein said means for limitation of the valve stem out of said valve stem receipt aperture include means to allow the thermal expansion and reciprocating movement of said valve stem within said valve stem receipt aperture.

* * * * *